United States Patent [19]

Luiten et al.

[11] 4,201,600

[45] May 6, 1980

[54] METHOD FOR THE GAS CARBURIZATION OF WORKPIECES MADE OF STEEL

[75] Inventors: Cornelis H. Luiten, Nijmegen, Netherlands; Werner Göhring, Kleve, Fed. Rep. of Germany

[73] Assignee: Ipsen Industries International GmbH, Kleve, Fed. Rep. of Germany

[21] Appl. No.: 942,978

[22] Filed: Sep. 18, 1978

[30] Foreign Application Priority Data

Sep. 22, 1977 [CH] Switzerland ..... 11608/77

[51] Int. Cl.[2] ..... C21D 1/48

[52] U.S. Cl. ..... 148/16.5; 148/16.6; 148/31.5

[58] Field of Search ..... 148/12.1, 16, 16.5, 148/16.6, 16.7, 31.5

[56] References Cited

U.S. PATENT DOCUMENTS

| | | | |
|---|---|---|---|
| Re. 22,452 | 3/1944 | Clements et al. | 148/12.1 |
| 1,076,768 | 10/1913 | Jones et al. | 148/12.1 |
| 1,100,193 | 6/1914 | Mitchell | 148/19 |
| 2,170,158 | 8/1939 | Rennerfelt | 148/16 |
| 2,201,181 | 5/1940 | Kalling | 148/16 |
| 2,827,407 | 3/1958 | Carlson et al. | 148/16.5 |
| 3,313,660 | 4/1967 | Vordahl | 148/12.1 |
| 4,035,203 | 7/1977 | L'Hermite et al. | 148/16.5 |
| 4,113,426 | 9/1978 | Rogers | 148/16.7 |

OTHER PUBLICATIONS

Metals Handbook, 8th ed. vol. 2, pp. 85–92, American Society for Metals.

*Primary Examiner*—L. Dewayne Rutledge
*Assistant Examiner*—John P. Sheehan
*Attorney, Agent, or Firm*—Martin A. Farber

[57] ABSTRACT

A method for gas carburization of workpieces made of steel in a furnace chamber, by which in the initial phase of the treatment more carbon than desired is released or dissolved in the workpiece surface and in the final phase of the treatment is decarburized to the desired edge carbon content by change of the quantity flow of the decarburizing gas. The decarburizing process is performed by exclusive introduction of a hydrogen-free, oxygen-containing decarburization gas in the furnace chamber.

12 Claims, No Drawings

METHOD FOR THE GAS CARBURIZATION OF WORKPIECES MADE OF STEEL

The invention relates to a method for gas carburization of workpieces made of steel in a furnace chamber particularly in the temperature range between 800°-1100° C., by which in the initial phase of the treatment more carbon than desired in the surface of the workpiece is released or dissolved, and in the end phase of the treatment is partially decarburized with a gas mixture to the desired edge carbon content, whereby the quantity flow of the gas mixture is controlled by the oxygen potential of the furnace atmosphere.

With the gas carburization of workpieces in a furnace chamber it is the aim of the invention to achieve a uniform carburization depth and a precise edge carbon content on the entire surface of the workpiece and at all positions of the charge. For economic reasons this should occur in a short treatment period and with a small apparatus expenditure.

According to the state of the art, a uniform carburization depth of the carburized workpiece surface is strived for in the manner that a gas containing carbon in a limited carbon concentration is brought into contact with the surface of the workpiece, so that the surface can receive the carbon and no soot or carbon black deposits form on the workpieces and in the furnace.

In spite of all efforts to control the carburization process, independent of the type of control still there always occurs considerable differences in the carbon depth within the charge. The places against which the circulated carburization gas directly flows carburize stronger than those places lying in the shadow or shade (indirect contact places) of the circulated gas stream. If larger carburization depths are strived for (approximately above 0.5 mm), in order to increase the penetration speed, at first one has to accept a higher edge carbon content and this edge carbon content thereafter is reduced to the desired value in a controlled partial decarburization process. A partial decarburization is to be understood according to German industrial standards DIN 17 014 as a decarburization which merely reduces the carbon content—to the contrary of total decarburization. The partial decarburization takes place by feeding or supplying a carbon- and hydrogen- containing gas mixture (endo gas—approximately 20% CO, 40% $H_2$, and the remainder $N_2$) with a corresponding addition of air in the framework of the chemical equilibrium. Also the reproducability of the carbon content of the edge according to the previous supercarburization or supercarbonization is still not satisfactory with a gas mixture of such type.

The task of the invention is to avoid shade effects with the carburization and in a short treatment time to achieve the most uniform carburization depth which is possible at all places of the workpieces within a tightly packed charge, and thereafter to bring the carbon content in the edge of the workpieces exactly and reproducably to the desired nominal value, without having to use expensively produced gas mixtures, such as, e.g., endo gas.

For a solution of this task in connection with the excess carburization process, a partial decarburization process is undertaken by exclusive introduction of a hydrogen-free, oxygen-containing partial decarburizing gas, whereby the quantity or volume flow stream of the partial decarburizing gas is regulated in a per se known manner such that the oxygen potential of the furnace atmosphere which develops during the partial decarburization process stands in chemical equilibrium with the desired edge carbon content of the workpiece. Preferably air is used as the partial decarburizing gas. Furthermore preferably the supercarburization or supercarbonization process in the initial phase is undertaken with soot or carbon black formation by an excess or oversupply of carbon in the carburizing gas, said excess or oversupply of carbon exceeding the dissolving power of the surface of the workpiece.

The invention is based on the following new recognitions.

1. The carbon level of the furnace atmosphere (DIN 17 014 sheet 1) and consequently the edge carbon content of the workpieces with the known method is determined by the chemical equilibrium with the carbon-containing and hydrogen-containing furnace atmosphere. For determination, its C/H— quantity proportion and consequently the CO— quantity or volume proportion must be known. During the decarburization process this changes continuously, however, since besides the known quantities of the carbon-containing and hydrogen-containing gases which are supplied, a non-determinable quantity of carbon is received by the furnace atmosphere furing the decarburization process. With the partial decarburization of the workpieces according to the invention preferably by air, only the reactable gas components CO and $CO_2$ arise in the furnace chamber. Since the gases substantially do not contain hydrogen, all of the oxygen which is introduced by the air exists in a form of CO and $CO_2$.

Since the oxygen-quantity proportion of the air is constant, the CO and $CO_2$ quantity proportion in the furnace chamber likewise reaches a constant value. Consequently the prerequisite condition is made to specifically ascertain the carbon level of the furnace atmosphere during the partial decarburization kinetics by means of a sole measurement of the $CO_2$ quantity proportion or of the oxygen potential by means of a solid body—electrolyte. The difference of the partial decarburization in accordance with the invention exclusively with air compared to the known partial decarburization of an endo gas air mixture is explained by a numerical example:

The carbon level of the furnace atmosphere is proportional to the ratio of the partial pressures $pCO^2/pCO_2$.

With endo gas made of natural gas, the CO value is constant at 20% volume and $CO_2$ is regulated by the addition of hydrocarbon or air to the desired value. During the partial decarburization, the control of the $CO_2$ value requires varying or changing air quantities. By reaction of the air which is supplied with the excess carbon, consequently these CO values of the furnace atmosphere vary as follows:

10% air addition to the endo gas yields 21.4% CO in the furnace chamber

20% air addition to the endo gas yields 22.8% CO in the furnace chamber

30% air addition to the endo gas yields 24.2% CO in the furnace chamber

50% air addition to the endo gas yields 27% CO in the furnace chamber

The erroneous ascertainment of the carbon level is evident, when one—as usual—starts from constant CO values of the furnace atmosphere. With the partial decarburization with air in accordance with the present invention, the CO content lies constant at 34% volume CO independent of the air quantity which is supplied by the control steps.

2. The uniformity or constancy of the carburization depth at all surfaces of the workpieces of a charge increases if there is present an oversupply of carbon beyond the quantities which are able to be absorbed by steel in the dissolved condition. With surfaces directly flowed-against by carburization gas, in this manner the carbon supply is so large that it exceeds the dissolving power of the steel surface for carbon. With surfaces lying in the shade of the circulating gas stream, the carbon supply is still so high that it corresponds at least to the absorption capacity of the workpiece surface. The soot or carbon black formation in the furnace and on certain places of the workpiece surface, which soot formation originates by the oversupply of carbon, is surprisingly not harmful, since contrary to suspicions expressed many times, there is no hindrance of the carburization process by the carbon deposits on the workpiece surface.

By the control process in the course of the partial decarburization phase, the air quantity which is fed is dosed so that essentially only CO develops as a combustion product in the furnace chamber. With air as the partial decarburization gas, the CO value lies constant at about 34%. The permissible $CO_2$ values of the furnace atmosphere are measured and represent the carbon level. According to these values the quantity flow stream of the air is controlled in the sense that with actual values of the $CO_2$ lying below the desired nominal value, the quantity flow stream of the air is increased. The numerical values depend on the desired edge carbon content of the workpieces and on the furnace temperature. With dried air as the partial decarburization gas, for example, with normal pressure the following composition exists:

| Carbon level | Furnace Chamber Temperature | | | | | | | |
|---|---|---|---|---|---|---|---|---|
| | 900° C. | 920° C. | 940° C. | 960° C. | 980° C. | 1000° C. | 1020° C. | 1040° C. |
| 0.6% | 0.753% CO2 | 0.612 | 0.499 | 0.410 | 0.341 | 0.283 | 0.238 | 0.201% CO2 |
| 0.7% | 0.626% CO2 | 0.509 | 0.414 | 0.341 | 0.283 | 0.235 | 0.198 | 0.168% CO2 |
| 0.8% | 0.529% CO2 | 0.430 | 0.350 | 0.288 | 0.239 | 0.199 | 0.167 | 0.141% CO2 |
| 0.9% | 0.454% CO2 | 0.343 | 0.279 | 0.230 | 0.191 | 0.158 | 0.133 | 0.113% CO2 |
| 1.0% | 0.393% CO2 | 0.320 | 0.261 | 0.215 | 0.178 | 0.148 | 0.125 | 0.105% CO2 |
| 1.1% | 0.346% CO2 | 0.264 | 0.215 | 0.176 | 0.147 | 0.122 | 0.103 | 0.087% CO2 |

(volume percent)

The previously stated $CO_2$ values with the partial decarburization in accordance with the present invention exclusively with air is about three times as high as with a conventional furnace atmosphere made of so-called endo gas made of natural gas. They apply when the atmosphere change from carburizing gas to partial decarburizing gas is finished. If the atmospheric change takes place by pumping-out (vacuum), thus the values apply without being limited. If the atmospheric change takes place by displacement of the carburizing atmosphere with air as a partial decarburization means, thus the basis of the values is a four time purging or flushing of the furnace chamber with the partial decarburization gas.

The corresponding values for the voltage of a solid body electrolyte (which conducts oxygen ions) on a zirconium oxide base, with the partial decarburization with dry air amounts to:

| Carbon level | Furnace Chamber Temperature | | | | | | | |
|---|---|---|---|---|---|---|---|---|
| | 900° C. | 920° C. | 940° C. | 960° C. | 980° C. | 1000° C. | 1020° C. | 1040° C. |
| 0.6% | 1086 | 1090 | 1094 | 1099 | 1103 | 1108 | 1112 | 1117 |
| 0.7% | 1095 | 1100 | 1104 | 1109 | 1113 | 1118 | 1123 | 1127 |
| 0.8% | 1104 | 1108 | 1113 | 1118 | 1123 | 1127 | 1132 | 1137 |
| 0.9% | 1111 | 1116 | 1121 | 1126 | 1131 | 1136 | 1140 | 1145 |
| 1.0% | 1119 | 1124 | 1129 | 1134 | 1138 | 1143 | 1148 | 1153 |
| 1.1% | 1125 | 1131 | 1136 | 1141 | 1146 | 1151 | 1156 | 1161 |

The values of the table are in millivolts, the reference gas is air, and the pressure is normal.

The method in accordance with the invention permits an exact partial decarburization. In this manner it is possible to perform the preceeding carburization process uncontrolled. If the amount of carbon absorbed by the workpiece differs, an uncontrolled oversupply of carbon leads to more or less carbon deposition in the furnace or on the surface of the workpiece. For the following controlled partial decarburization operation this means that for maintaining the desired carbon level, depending upon the existing carbon quantity, more or less flow of air is supplied.

As previously explained, the workpiece-uniformity requires no control of the carburization process with a strong excess-carburization. In practical furnace operation however such is recommendable. The excess carbon of the carburization operation, namely, is the starting point of the furnace atmosphere of the partial decarburization operation and must be present in sufficient quantity.

The strong excess-carburization is caused by introducing hydrocarbon material (e.g., natural gas or propane) into the furnace chamber. In this manner the quantity of the carbon which deposits in the furnace chamber is varied by change of the hydrocarbon quantity proportion which is fed. The following are suited as control conditions or variables:

an optical measurement of the cloudiness of the furnace atmosphere or of the workpieces by soot formation;

an analysis of the $CH_4$ quantity proportion existing in the furnace chamber.

To guarantee that the carbon, which is necessary for the production of the partial decarburization gas quantity, is covered, also a carbon-containing solid body can be led into the furnace chamber, which solid body emits carbon when the carbon which is deposited during the supercarburization process is not sufficient. With particularly high requirements or demands on the uniformity of the carburization depth, the carburization process is performed at pressure above atmospheric, or pulsing normal pressure—pressure above atmospheric. In this manner circulation of the carburization gas, which circulation was necessary heretofore for the gas distribution and flushing, can be eliminated and done away with, since the furnace atmosphere which stands under pressure promotes sufficient carbon in the narrow gaps of a tight or dense charge. By the pressure above atmospheric, more activation molecule collisions of the gases occur with one another, which collisions promote the separation of the hydrocarbons and consequently the carbon emission. Consequently the passivating effect of the collisions of molecules against the wall inside of the charges is covered, since with the gas pressure, the number of the activation molecular collisions with one another increases by the square, however the number of the passivating wall collisions only increases linearly. Consequently with increasing gas pressure, the carburization shade effect on the concave points, e.g., blind holes or inner edges is reduced, the carburization shade effect being dependent on the form of the workpiece itself.

Also the partial decarburization process in accordance with the present invention can be performed with pressure greater than atmospheric, or pulsating normal pressure—pressure above atmospheric pressure.

The quality of the workpiece which are made of steel is very good, the workpieces being carburized by pure hydrocarbons and thereafter partially decarburized in a hydrogen-free furnace atmosphere. During the carburization process—to the contrary of the conventional carburization in CO-containing endo gas—no oxygen is transferred which is not desired. Consequently thus with the carburization process, no longer does a non-reversible edge oxidation occur. During the partial decarburization in hydrogen-free gas, hydrogen which has penetrated during the carburization process again can escape. Consequently the partial decarburization in accordance with the method of the invention in comparison with the known methods produces no quality reduction on the workpieces by oxygen or hydrogen being absorbed.

The method may be explained on the basis of the following examples:

A charge (350 kg) with cam shafts standing tightly or close together to one another is supercarburized or supercarbonized at 1,020° C. for 3 hours by feeding of approximately $V_n=7m^3/h$ natural gas in an automatic chamber furnace with soot formation. Thereafter the natural gas feed is stopped and at first $V_n=8m^3/h$ air is fed. After a few minutes the $CO_2$ nominal value of 0.13% is reached and a motor valve throttles the air quantity which is fed. At the end of the partial decarburization time of 45 minutes, the air quantity which is necessary for maintaining the $CO_2$ nominal value amounts only to $V_n=3m^3/h$. The entire air consumption for the partial decarburization of the charge amounted to $V_n=4m^3/h$. Consequently during the partial decarburization phase, 900 g carbon was gasified.

Result: Carburization or Case Hardening Depth 2.2 mm±0.1 mm
- Edge carbon content: 0.95%
- Structure: Martensite, even on the outer edges free of carbides
- Appearance: clear and soot free The carburization speed which is achieved is so high as it otherwise is achieved only with the so-called under atmospheric pressure—carburization. The same charge with conventional gas carburization without depositing of free carbon during the carburization phase shows a lower case hardening depth (1.6 mm) with larger variation values (±0.3 mm).

With another embodiment, nozzle bodies for a diesel motor are carburized as follows:

Treatment temperature: 850°
- supercarburization: 1.75 hours with propane Mass or Quantity flow controlled with 35% CH4, measured in the furnace chamber
- partial decarburization: 1.5 hours with air, mass flow controlled with solid body-electrolyte 1092 mV Result:

On the inside of the valve seat:
- carburization depth 0.52 mm Eht (case hardening depth): 550 HVl
- edge hardness: 820 HVl On the outer side:
- carburization depth 0.60 mm Eht: 550 HVl
- Edge Hardness: 840 HVl
- Structure: Martensite, no carbides, no visible remaining austensite.

The example shows the uniformity of the carburization on a particularly difficult workpiece. In the inside of a blind hole with 6 mm diameter and 50 mm depth, the carburization depth and the edge hardness which represents the edge carbon content differ only insubstantially from the values ascertained on the outer side of the blind hole. The method of the invention consequently is very advantageous. With simultaneous quality improvement, the construction expense and the energy requirements are considerably reduced. A further advantage is that no particular requirements need be set concerning the constant composition of the hydrocarbon, as this is the case for production of the endothermic protective gas.

The method is not obvious, since it surpasses the prejudice of the people in the field that the soot formation during the carburization process must be prevented. Furthermore it surpasses the prejudice to lead air in without mixing with reducing gas in a furnace chamber. The generally expected oxidation of the workpieces does not occur. To the contrary, the workpieces leave the carburization furnace with non-objectionable clear or clean surfaces.

We claim:

1. A method of gas carburization of workpieces made of steel in a furnace chamber, comprising the steps of flowing a carburizing gas in the furnace chamber and dissolving in workpiece surfaces in an initial phase of treatment excess carbon than is ultimately desired at carburization temperatures from about 800 to 1000 degrees C., said excess carbon exceeding the dissolving power of the workpiece surfaces for carbon and at least corresponding to the absorption capacity for carbon of workpiece surfaces disposed in the shade (indirect contact places) of the flow of the decarburizing gas, and decarburizing the workpieces in a final phase of the treatment to a desired certain edge carbon content by changing of the quantity flow of a decarburizing gas, the decarburizing process being performed by exclusively introducing a substantially hydrogen-free oxygen-containing decarburization gas in the furnace chamber, the initial phase constituting a supercarburization operation is performed with soot deposit on said workpiece surfaces by an oversupply of carbon in the carburization gas, the oversupply exceeding the dissolving power of the surface of the workpieces, and in the initial phase, exclusively a hydrocarbon is fed into the furnace chamber for supercarburization, a nitrogen-oxygen mixture constituting air exclusively is used as said decarburization gas, controlling the soot deposit on said workpiece by varying a supplied quantity of the hydrocarbon, controlling the decarburizing by the oxygen potential in the air and varying the flow of the air into the furnace chamber dependent thereon.

2. The method according to claim 1, further comprising the step of optically measuring the soot formation mist of the furnace atmosphere as a control variable for the soot deposit.

3. The method according to claim 1, further comprising the step of analysing a CH4 quantity proportion of the furnace atmosphere in the furnace chamber as a control variable condition for the soot deposit.

4. The method according to claim 1, further comprising the step of additionally introducing a carbon-containing solid body into the furnace chamber.

5. The method according to claim 1, further comprising the step of controlling the quantity flow of the air into the furnace chamber in dependency on the furnace temperature and the desired carbon level to the following $CO_2$ values with dry air at normal pressure:

| Carbon Level of the workpiece surface | Furnace Chamber Temperature | | | | | | | |
|---|---|---|---|---|---|---|---|---|
| | 900° C. | 920° C. | 940° C. | 960° C. | 980° C. | 1000° C. | 1020° C. | 1040° C. |
| 0.6% | 0.753% CO2 | 0.612 | 0.499 | 0.410 | 0.341 | 0.283 | 0.238 | 0.201% CO2 |
| 0.7% | 0.626% CO2 | 0.509 | 0.414 | 0.341 | 0.283 | 0.235 | 0.198 | 0.168% CO2 |
| 0.8% | 0.529% CO2 | 0.430 | 0.350 | 0.288 | 0.239 | 0.199 | 0.167 | 0.141% CO2 |
| 0.9% | 0.454% CO2 | 0.343 | 0.279 | 0.230 | 0.191 | 0.158 | 0.133 | 0.113% CO2 |
| 1.0% | 0.393% CO2 | 0.320 | 0.261 | 0.215 | 0.178 | 0.148 | 0.125 | 0.105% CO2 |
| 1.1% | 0.346% CO2 | 0.264 | 0.215 | 0.176 | 0.147 | 0.122 | 0.103 | 0.087% CO2 |

(volume percent)

6. The method according to claim 1, further comprising the step of regulating the quantity flow of the air into the furnace chamber in dependency on the furnace temperature and the desired carbon level to the following voltages of a solid body—electrolyte on zirconium oxide which conducts oxygen ions wherein the values of the table are in millivolts, the reference gas is dry air, and the pressure is normal:

| Carbon Level of the workpiece surface | Furnace Chamber Temperature | | | | | | | |
|---|---|---|---|---|---|---|---|---|
| | 900° C. | 920° C. | 940° C. | 960° C. | 980° C. | 1000° C. | 1020° C. | 1040° C. |
| 0.6% | 1086 | 1090 | 1094 | 1099 | 1103 | 1108 | 1112 | 1117 |
| 0.7% | 1095 | 1100 | 1104 | 1109 | 1113 | 1118 | 1123 | 1127 |
| 0.8% | 1104 | 1108 | 1113 | 1118 | 1123 | 1127 | 1132 | 1137 |
| 0.9% | 1111 | 1116 | 1121 | 1126 | 1131 | 1136 | 1140 | 1145 |
| 1.0% | 1119 | 1124 | 1129 | 1134 | 1138 | 1143 | 1148 | 1153 |
| 1.1% | 1125 | 1131 | 1136 | 1141 | 1146 | 1151 | 1156 | 1161 |

7. The method according to claim 1, further comprising the step of changing the furnace atmosphere from a supercarburization gas to a partial decarburization gas by evacuation of the furnace chamber and introducing the decarburizing gas.

8. The method according to claim 1, including the step of supercarburizing the workpieces at a constant pressure above atmospheric up to 3 bar, respectively.

9. The method according to claim 1 wherein a partial decarburization of the workpieces is performed under a constant pressure above atmospheric up to 3 bar.

10. The method according to claim 1, including the step of supercarburizing the workpieces at pulsing normal pressure—pressure above atmospheric up to 3 bar.

11. The method according to claim 1, wherein a partial decarburization of the workpieces is performed under pulsing normal pressure—pressure above atmospheric up to 3 bar.

12. The method according to claim 1, further comprising the step of optically measuring the soot formation of the workpieces as a control variable for the soot deposit.

* * * * *